US006799387B2

(12) United States Patent
Pippins

(10) Patent No.: US 6,799,387 B2
(45) Date of Patent: Oct. 5, 2004

(54) REMOVABLE ADAPTER ASSEMBLY HAVING A RETRACTABLE INSERT

(75) Inventor: Sherlock K. Pippins, Dallas, TX (US)

(73) Assignee: TRN Business Trust, Dallas, TX (US)

( * ) Notice: Subject to any disclaimer, the term of this patent is extended or adjusted under 35 U.S.C. 154(b) by 43 days.

(21) Appl. No.: 10/060,269

(22) Filed: Jan. 29, 2002

(65) Prior Publication Data

US 2003/0140531 A1 Jul. 31, 2003

(51) Int. Cl.[7] ..... E02F 9/28
(52) U.S. Cl. ..... 37/456
(58) Field of Search ..... 37/450, 458, 446, 37/398, 395; 403/373, 374, 355, 320, 21, 22

(56) References Cited

U.S. PATENT DOCUMENTS

| | | | | |
|---|---|---|---|---|
| 1,216,290 | A | 2/1917 | Dickson | |
| 1,419,047 | A | 6/1922 | Hanks et al. | |
| 1,845,677 | A | 2/1932 | Mekeel | |
| 2,064,059 | A | 12/1936 | Fellmeth | 37/142 |
| 2,113,420 | A | 4/1938 | Younie | 37/141 |
| 2,618,873 | A | 11/1952 | Hostetter | 37/142 |
| 2,635,366 | A | 4/1953 | Hostetter | 37/142 |
| 2,689,419 | A | 9/1954 | Daniels et al. | 37/142 |
| 2,934,842 | A | 5/1960 | Van Buskirk | 37/142 |
| 3,027,201 | A | 3/1962 | Blazek et al. | 305/58 |
| 3,068,737 | A | 12/1962 | Mewse | 85/5 |
| 3,498,677 | A | 3/1970 | Morrow | 299/86 |
| 3,787,132 | A | 1/1974 | Garnett | 403/290 |
| 3,839,805 | A | 10/1974 | Stepe | 37/141 |
| 3,879,867 | A | 4/1975 | Ericson | 37/142 |
| 3,896,569 | A | 7/1975 | Thompson et al. | 37/141 |
| 3,967,399 | A | 7/1976 | Heinold et al. | 37/142 |
| 3,974,579 | A | 8/1976 | Black et al. | 37/141 |
| 3,982,339 | A | 9/1976 | Nilsson | 37/141 |

(List continued on next page.)

FOREIGN PATENT DOCUMENTS

| | | | |
|---|---|---|---|
| AU | 199911346 A1 | 7/2000 | E02F/9/28 |
| AU | 200154094 A1 | 1/2002 | E02F/9/28 |
| CA | 2161505 A1 | 4/1997 | E02F/3/36 |
| CA | 2161505 | 4/1997 | E02F/3/36 |

OTHER PUBLICATIONS

International Search Report for Trinity Industries, Inc., regarding International application No. PCT/US 02/27402 signed by Paul Faux (8 pages).

"Dragline Products—Hensley Style" (eleven pages).

"Keech Castings Australia PTY. Limited," Aug. 31, 1995 (one page).

"Maglok™ System," *Quality Steel Foundaries Ltd.*

"Mining Vertalok™ Adapters for Shovel Dippers," ©1992 ESCO Corporation. (4 pages).

"Posilok™ Tooth Systems" (one page).

"Torqlok™ System," *Quality Steel Foundaries Ltd.* (one page).

PCT International Search Report in International Application No. 08/20075, dated Jun. 25, 2003, 8 pages.

PCT International Search Report in International Application No. 08/01664, dated Mar. 15, 2004, 6 pages.

*Primary Examiner*—Robert E. Pezzuto
(74) *Attorney, Agent, or Firm*—Baker Botts L.L.P.

(57) ABSTRACT

A removable adapter assembly includes a tapered body portion having a first end configured to receive a tooth horn, and a second end configured to receive a removable tooth. The tapered body may include first and second sides, which partially define a recess adjacent the first end. First and second interior surfaces of the first and second sides, respectively, have first and second gripping surfaces, respectively. The first and second gripping surfaces are configured to cooperate with a retractable insert that is coupled with the tooth horn. The tapered body is coupled with the tooth horn when the retractable insert is in a first extended position, and the tapered body may be removed from the tooth horn when the insert is in a second, retracted position.

16 Claims, 2 Drawing Sheets

U.S. PATENT DOCUMENTS

| | | | | |
|---|---|---|---|---|
| 4,067,657 | A | 1/1978 | Kaariela | 403/317 |
| 4,120,105 | A | 10/1978 | Stepe | 37/142 |
| 4,233,761 | A | 11/1980 | Ryerson | 37/142 |
| 4,247,147 | A | 1/1981 | Rettkowski | 299/10 |
| 4,326,348 | A | 4/1982 | Emrich | 37/142 |
| 4,335,532 | A | 6/1982 | Hahn et al. | 37/142 |
| 4,404,760 | A | 9/1983 | Hahn et al. | 37/142 |
| 4,414,764 | A | 11/1983 | Johansson et al. | 37/141 |
| 4,433,496 | A | 2/1984 | Jones et al. | 37/141 |
| 4,446,638 | A | 5/1984 | Novotay et al. | 37/142 |
| 4,481,728 | A | 11/1984 | Mulder et al. | 37/142 |
| 4,587,751 | A | 5/1986 | Sjogren et al. | 37/142 |
| 4,662,762 | A | 5/1987 | Schwarz | 384/25 |
| 4,663,867 | A | 5/1987 | Hahn et al. | 37/142 |
| 4,716,667 | A | 1/1988 | Martin | 37/142 |
| 4,727,663 | A | 3/1988 | Hahn | 37/142 |
| 4,782,607 | A | 11/1988 | Frisbee et al. | 37/141 |
| 4,823,487 | A | 4/1989 | Robinson | 37/142 |
| RE33,042 | E | 9/1989 | Emrich | 37/142 |
| 4,895,459 | A | 1/1990 | Werner | 384/43 |
| 4,932,145 | A | 6/1990 | Reeves, Jr. | 37/141 |
| 4,941,758 | A | 7/1990 | Osawa | 384/43 |
| 5,009,017 | A | 4/1991 | Diekevers et al. | 37/142 |
| 5,074,062 | A | 12/1991 | Hahn et al. | 37/142 |
| 5,081,774 | A | 1/1992 | Kuwano | 137/142 |
| 5,088,214 | A | 2/1992 | Jones | 37/141 |
| 5,111,600 | A | 5/1992 | Lukavich et al. | 37/141 |
| 5,152,088 | A | 10/1992 | Hahn | 37/142 |
| 5,172,501 | A | 12/1992 | Pippins | 37/142 |
| 5,181,780 | A | 1/1993 | Morita | 384/8 |
| 5,233,770 | A | 8/1993 | Robinson | 37/456 |
| 5,263,351 | A | 11/1993 | Berg, III | 72/208 |
| 5,297,873 | A | 3/1994 | Komiya | 384/45 |
| 5,337,495 | A | 8/1994 | Pippins | 37/453 |
| 5,361,520 | A | 11/1994 | Robinson | 37/458 |
| 5,410,826 | A | 5/1995 | Immel et al. | 37/457 |
| 5,423,138 | A | 6/1995 | Livesay et al. | 37/456 |
| 5,435,084 | A | 7/1995 | Immel | 37/398 |
| 5,452,529 | A | 9/1995 | Neuenfeldt et al. | 37/455 |
| 5,469,648 | A | 11/1995 | Jones et al. | 37/457 |
| 5,484,210 | A | 1/1996 | Gallone | 384/49 |
| 5,491,915 | A | 2/1996 | Robinson | 37/458 |
| 5,638,621 | A | 6/1997 | Keech et al. | 37/446 |
| 5,709,043 | A | 1/1998 | Jones et al. | 37/458 |
| 5,802,795 | A | 9/1998 | Myers et al. | 52/426 |
| 5,909,962 | A | 6/1999 | Livesay et al. | 37/456 |
| 5,926,982 | A | 7/1999 | Keech et al. | 37/455 |
| 5,937,550 | A | 8/1999 | Emrich | 37/458 |
| 5,947,209 | A | 9/1999 | Halford et al. | 172/772.5 |
| 5,983,534 | A | 11/1999 | Robinson et al. | 37/459 |
| 5,992,063 | A | 11/1999 | Mack | 37/450 |
| 6,000,153 | A | 12/1999 | Sollami | 37/453 |
| 6,018,896 | A | 2/2000 | Adamic | 37/456 |
| 6,052,927 | A | 4/2000 | Pippins | 37/454 |
| 6,092,958 | A | 7/2000 | Gale | 403/378 |
| 6,108,950 | A | 8/2000 | Ruvang et al. | 37/452 |
| 6,119,378 | A | 9/2000 | Pippins | 37/454 |
| 6,151,812 | A | 11/2000 | Bierwith | 37/455 |
| 6,247,255 | B1 | 6/2001 | Clendenning | 37/452 |
| 6,301,810 | B1 | 10/2001 | Fidler | 37/458 |
| 6,374,521 | B1 | 4/2002 | Pippins | 37/456 |
| 6,467,203 | B2 | 10/2002 | Pippins | 37/452 |
| 6,467,204 | B1 | 10/2002 | Creighton et al. | 37/456 |
| 2002/0000053 | A1 | 1/2002 | Adamic et al. | 37/456 |
| 2002/0010994 | A1 | 1/2002 | Hess | 29/426.5 |
| 2002/0023375 | A1 | 2/2002 | Pippins | 37/457 |

REMOVABLE ADAPTER ASSEMBLY HAVING A RETRACTABLE INSERT

TECHNICAL FIELD OF THE INVENTION

The present invention relates to replaceable machine parts that are exposed to high wear and repeated shock loading such as adapters used on excavating machines, and more particularly, to a removable adapter assembly system and method.

BACKGROUND OF THE INVENTION

Digging and leveling apparatus such as drag lines, back hoes, front-end loaders and the like often use replaceable adapter assemblies which are mounted on a tooth horn to provide sacrificial parts that are exposed to the repeated shock loading and high wear occasioned by digging operations. In such systems, adapter assemblies may include a wedge-shaped adapter which mounts directly on the tooth horn of a bucket, shovel or alternative digging or scraping mechanism of the equipment. The wedge-shaped adapter is frontally seated on and coupled with the tooth horn and may be configured to receive a tooth assembly.

SUMMARY OF THE INVENTION

The present invention includes a removable adapter assembly having a retractable insert that substantially eliminates or reduces disadvantages or problems associated with previously developed removable component methods and systems. In particular, the present invention provides a system and method for coupling an adapter assembly with a tooth horn in a simplified manner, using hand tools.

In accordance with a particular embodiment, a removable adapter assembly includes a tapered body portion having a first end configured to receive a tooth horn, and a second end configured to receive a removable tooth. The tapered body portion includes first and second sides, which partially define a recess adjacent the first end. First and second interior surfaces of the first and second sides, respectively, include first and second gripping surfaces, respectively. The first and second gripping surfaces are configured to cooperate with a retractable insert that is coupled with the tooth horn. The tapered body is coupled with the tooth horn when the retractable insert is in a first extended position, and the tapered body may be removed from the tooth horn when the insert is in a second, retracted position.

In accordance with another embodiment, the gripping surfaces comprise first and second pluralities of gripping teeth, respectively. The first and second pluralities of gripping teeth are configured to cooperate with associated third and fourth pluralities of gripping teeth, which extend from opposing first and second ends of the insert, respectively, to secure the tapered body to the tooth horn when the insert is in the first position.

In accordance with yet another embodiment, the insert comprises a biasing element disposed between first and second portions of the elongate body. The first and second portions of the insert include the third and fourth pluralities of gripping teeth, respectively. The biasing element is operable to maintain the first and second portions in respective outwardly extended positions when the insert is in the first position.

In accordance with still another embodiment, the first and second sides include first and second removable racks, respectively. The first and second racks are at least partially recessed relative to the first and second interior surfaces, respectively. The first and second racks also include the first and second gripping teeth, respectively.

Technical advantages of particular embodiments of the present invention include a system and method for securely coupling an adapter assembly with a tooth horn, using a retractable insert assembly. The insert assembly is easily manipulated between a first extended position, and a second retracted position. Accordingly, an operator may install, remove, and/or replace the adapter assembly in the field, using hand tools.

Another technical advantage of particular embodiments of the present invention includes a system and method for coupling a removable adapter assembly with a tooth horn, where an extended use, wear and tear on the adapter assembly strengthens the coupling with the tooth horn. The configuration of tapered cooperating gripping surfaces of the insert assembly and the adapter allow the strength of the coupling to be increased, or at least maintained during use.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

Figure 1A:
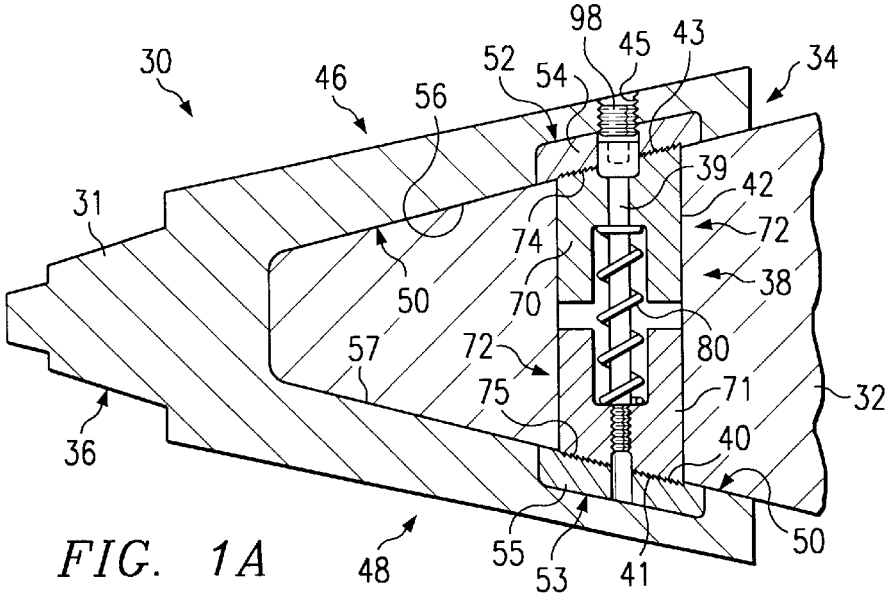
FIG. 1A is a cross sectional top view of a removable adapter assembly having a retractable insert assembly coupling the adapter assembly with a tooth horn, in accordance with a particular embodiment of the present invention.
Figure 1B:
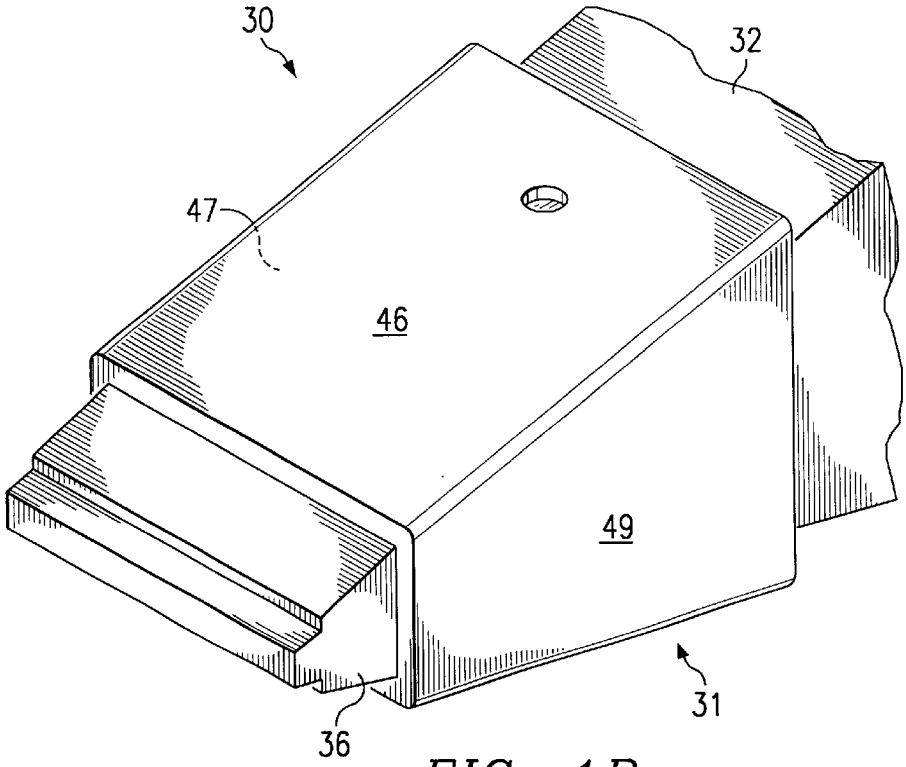
FIG. 1B is an isometric view of the adapter assembly of FIG. 1, coupled with the tooth horn.

FIGS. 1A and 1B illustrate a removable adapter assembly 30 that may be removably coupled with tooth horn 32 of a bucket, shovel or other part of an excavating machine. Accordingly, removable adapter assembly 30 includes a first end 34 configured to receive tooth horn 32 at least partially therein. A second end 36 of removable adapter assembly 30 is configured to receive a removable tooth thereon. An insert assembly 38 associated with removable adapter assembly 30 secures a tapered body portion 31 of removable adapter assembly 30 in place upon tooth horn 32. Insert assembly 38 has a first position in which opposing gripping surfaces 40 and 42 cooperate with corresponding gripping surfaces 41 and 43, respectively, to prevent decoupling of tapered body portion 31 from tooth horn 32. In a second position of insert assembly 38, gripping surfaces 40 and 42 are retracted inwardly, which allows tapered body portion 31 to be removed from tooth horn 32. Insert assembly 38 may be rotated between its first and second positions using a threaded fastener 39, which extends through insert assembly 38.

Insert assembly 38 provides for the simplified installation and/or removal of tapered body portion 31 from tooth horn 32. Such adapters may be installed or removed by an operator in the field using hand tools. The configuration of insert assembly 38 and gripping surfaces 41 and 43 prevent shifting or loosening of the coupling between tapered body portion 31 and tooth horn 32, over time. Instead, continued use and extended wear tend to increase or at least maintain the strength of the coupling by shifting gripping surfaces 41 and 43 toward tooth horn 32. As gripping surfaces 41 and/or 43 are pushed backward, they engage teeth upon gripping surfaces 40 and 42 that are spaced further apart from one another, thereby strengthening the coupling and removing any "slack" created due to extended use and/or wear.

Removable adapter assembly. 30 is subject to significant wear and tear during excavation and/or mining operations. Extreme shock loading is experienced as adapter assembly 30 impacts adjacent earth, rocks, and other abrasive material. Therefore, it is desirable to make adapter assembly 30 readily replaceable with a new or reconditioned adapter assembly of similar or identical configuration. Otherwise, buckets, shovels or other excavation equipment would need to be replaced more frequently, increasing equipment and labor costs associated therewith. By providing a replaceable adapter assembly 30 at a location upon the excavation equipment that experiences the most wear, the service life of such equipment is prolonged by replacing selected parts associated with the excavation equipment.

In order to prevent excessive wear of tooth horn 32, for example, removable adapter assembly 30 is coupled with and at least partially conceals and/or protects tooth horn 32 from abrasive materials which are engaged during excavation. Adapter assembly 30 includes rigid tapered body portion 31. Tapered body portion 31 generally includes four sides 46–49, which cooperate to define a recess 50 at first end 34. Recess 50 is configured to receive tooth horn 32 therein. Sides 46 and 48 are spaced from one another at first end 34. Each of sides 46 and 48 is tapered, and they converge at or near second end 36.

Sides 46 and 48 include respective recesses 52 and 53, which are configured to receive first and second inserts, or racks 54 and 55, respectively. Prior to installing tapered body portion 31 over tooth horn 32, racks 54 and 55 are inserted into recesses 52 and 53, respectively. Racks 54 and 55 may be coupled with tapered body portion 31 using various techniques. In the illustrated embodiment, for example, racks 54 and 55 are installed within tapered body portion 31 using an adhesive material. In alternative embodiments, however, various mechanical fastening techniques may be used. For example, racks 54 and 55 may be installed using one or more threaded fasteners which extend into tapered body portion 31. In yet another embodiment, racks 54 and 55 may be permanently installed within tapered body portion 31 by various techniques, including welding. In still another embodiment, racks 54 and 55 are integral components to tapered body portion 31, and gripping surfaces 41 and 43 are formed along interior faces 56 and 57 of tapered body portion 31. In accordance with particular embodiments of the present invention, it may be desirable to remove and/or replace racks 54 and 55, so the adhesive of the illustrated embodiment is selected to allow the removal of racks 54 and 55 by an operator using simple hand tools.

The configuration of tapered body portion 31 may vary significantly within the teachings of the present invention. For example, although sides 46 and 48 are each tapered and sides 47 and 49 are generally parallel with one another, other embodiments may include only one tapered side. Alternatively, more than two sides 46–49 may be tapered, within the teachings of the present invention. Furthermore, tapered body portion 31 may include more than four sides in various embodiments.

Figure 2:
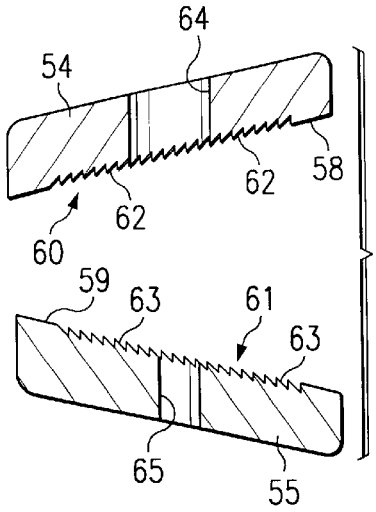
FIG. 2 illustrates removable rack assemblies of the adapter assembly of FIG. 1, in accordance with a particular embodiment of the present invention.

FIG. 2 illustrates racks 54 and 55 in more detail. Racks 54 and 55 are installed along interior faces 56 and 57, respectively of tapered body portion 31. Each rack 54 and 55 is a generally uniform thickness and includes interior surfaces 58 and 59, respectively, which generally follow the taper of interior faces 56 and 57. Each rack 54 and 55 includes a gripping surface 41 and 43, respectively, along interior surfaces 58 and 59, respectively. In the illustrated embodiment, gripping surfaces 41 and 43 include a plurality of gripping teeth 40 and 42, respectively. However, other gripping surfaces may be provided within the teachings of the present invention.

In accordance with particular embodiments of the present invention it is desirable that gripping surfaces 41 and 43 prevent movement of insert assembly 38 with respect to racks 54 and 55. Accordingly, various rough surfaces, or corresponding configurations between racks 54 and 55 and insert assembly 38 which prevent movement of insert assembly 38 with respect to racks 54 and 55 may be used. More specifically, in the illustrated embodiment gripping surfaces 41 and 43 are configured to cooperate with gripping surfaces 40 and 42 of insert assembly 38 and allow gripping surfaces 41 and 43 to lock into gripping surfaces 40 and 42, respectively.

The number and configuration of racks 54 and 55 may be significantly modified within the teachings of the present invention. For example, in the illustrated embodiment two racks 54 and 55, each having gripping surfaces 41 and 43, respectively, formed thereon are used. In another embodiment, a single one of racks 54 or 55 may be used to couple tapered body portion 31 with insert assembly 38. Alternatively, racks 54 and 55 may be excluded entirely, and one or more gripping surfaces similar to gripping surfaces 41 and 43 may be formed upon one or more of sides 46–49 of tapered body portion 31.

Figure 3:
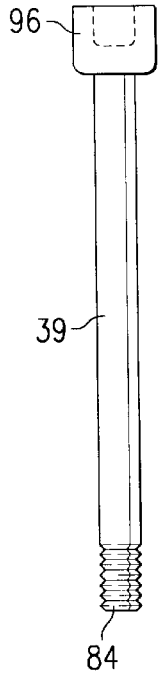
FIG. 3 illustrates a threaded fastener of FIG. 1, which may be used to couple the insert assembly and a tapered body portion of the adapter assembly, in accordance with a particular embodiment of the present invention.

Each rack 54 and 55 includes a fastener opening 64 and 65, respectively, disposed therethrough, to accommodate fastener 39 (FIG. 3). The cooperation between fastener openings 64 and 65, and fastener 39 will be described later, in more detail.

Figure 4:
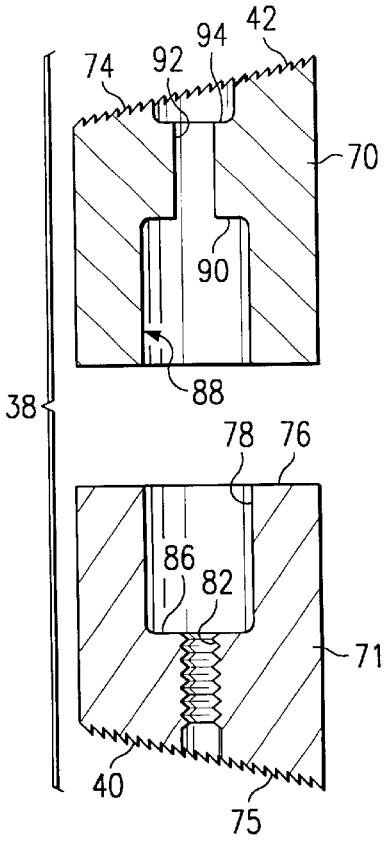
FIG. 4 illustrates two body portions of the insert assembly of FIG. 1.

Insert assembly 38 is illustrated in FIG. 4, in more detail. Insert assembly 38 includes first and second body portions 70 and 71, respectively, which are configured to be received at least partially through a slot 72 formed through tooth horn 32. Each body portion 70 and 71 are generally cylindrical configurations and include tapered ends 74 and 75, respectively. Gripping surfaces 40 and 42 are formed upon tapered ends 74 and 75, respectively, of body portions 70 and 71, respectively.

Figure 5:
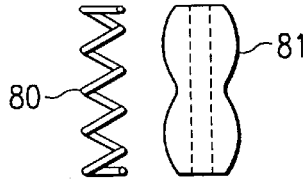
FIG. 5 illustrates two biasing elements which may be used with the insert assembly of FIG. 1, in accordance with various embodiments of the present invention.

Body portion 71 includes a first end 76 having a recessed portion 78 configured to receive a biasing element therein, for example spring 80. A threaded fastener opening 82 is disposed between recess 78 and tapered end 75 of body portion 71. Threaded fastener opening 82 is configured to receive a threaded end 84 of fastener 39. A shoulder 86 disposed within recessed portion 78 is operable to engage spring 80, when insert assembly 38 is in the installed position. Other biasing elements may be used within the teachings of the present invention, in lieu of or in addition to spring 80. For example, an elastomer biasing element 81 is illustrated in FIG. 5. It should be recognized by those having ordinary skill in the art, that various members and/or means may be used in lieu of spring 80. Such elements or means may be selected based upon their ability to maintain body portions 70 and 71 in an extended position relative to one another. Such elements or means should also include sufficient compressibility such that engagement between threads of fasteners 39 and corresponding threads of body portion 71 can retract body portions 70 and 71 relative to one another.

Body portion 70 also includes a recessed portion 88, similar in configuration to recessed portion 78 of body portion 71. Recessed body portion 88 includes shoulder 90, which is operable to engage spring 80 when insert assembly 38 is in the installed position. A fastener opening 92 is disposed between recessed body portion 88 and tapered end 74 of body portion 70. Fastener opening 92 is countersunk at its end adjacent tapered end 74. Accordingly, a shoulder 94 is provided, which is operable to engage a fastener head 96 of fastener 39.

In the illustrated embodiment, a cover plug 98 is inserted into fastener opening 92. Cover plug 98 is used to keep debris out of opening 92 when adapter assembly 30 is in use. In the illustrated embodiment, cover plug 98 is threaded to facilitate insertion into and removal from opening 92. However, in alternative embodiments, cover plug 98 may be coupled with adapter assembly 30 in a different manner, for example a friction fit.

In the installed position, spring 80 is installed within recessed portions 78 and 88 of body portions 71 and 70, respectively. Fastener 39 is inserted through fastener openings 82 and 92. Threaded end 84 of fastener 39 engages threaded fastener opening 82 of body portion 71 in order to secure fastener 39 and lower body portion 71. Fastener head 96 engages shoulder 94 of fastener opening 92 in order to secure fastener 39 with body portion 70. Therefore, rotation of fastener 39 in a first direction will draw body portions 70 and 71 closer together and compress spring 80. Conversely, rotation of fastener 39 in a second direction, opposite the first direction, allows spring 80 to force body portions 70 and 71 away from one another. An optional cover plug 98 is provided within fastener opening 45 through side 46, in order to protect fastener 39 from ambient environmental conditions.

In order to install adapter assembly 30 upon tooth horn 32, body portions 70 and 71 are installed within slot 72 of tooth horn 32, with spring 80 disposed therebetween, within recessed portions 78 and 88. Spring 80 maintains body portions 70 and 71 in a spaced relationship to one another, and urges them outwardly with respect to one another. Surfaces 86 and 90 of body portions 71 and 70, respectively, engage spring 80 and maintain spring 80 within recesses 78 and 88.

Next, threaded fastener 39 is inserted through openings 82 and 92 of body portions 71 and 70, respectively, until threaded region 84 engages threads 82 and/or head 96 of fastener 39 engages shoulder 94 of body portion 70. As fastener 39 is rotated in a clockwise direction, the cooperation between threads 82 and 84 draw body portion 71 toward body portion 70. Engagement between head 96 and shoulder 94 maintains body portion 70 in position, such that spring 80 is compressed and the distance between body portions 70 and 71 is decreased. Threaded fastener 39 is rotated in this manner until surfaces 40 and 42 are generally flush with sides 56 and 57, or slightly recessed.

Tapered body portion 31 is then slidably inserted over tooth horn 32 until surfaces 41 and 43 are generally adjacent surfaces 40 and 42, respectively. When threaded fastener 39 is rotated in a counterclockwise direction, spring 80 forces body portions 70 and 71 apart, such that surfaces 40 and 42 extend outwardly. Eventually, surfaces 40 and 42 engage surfaces 41 and 43, respectively, and a coupling between insert assembly 38 and tapered body portion 31 is formed.

In order to ensure a proper coupling, a force is applied at end 36 of tapered body portion 31 toward tooth horn 32. This slides surfaces 41 and 43 along surfaces 40 and 42. Because of the tapered configuration, this forms a more secure coupling between surfaces 41 and 43, and 40 and 42, respectively. Also, as discussed above, forces experienced at end 36 of tapered body portion 31 during operation will have a similar impact, and "slack" caused by wear and tear is reduced.

Tapered body portion 31 may be removed from tooth horn 32, using a similar procedure. Threaded fastener 39 is rotated in a clockwise direction until body portions 70 and 71 are retracted and surfaces 40 and 42 are generally flush with, or recessed with respect to surfaces 41 and 43, respectively. This allows tapered body portion 31 to be slidably removed from tooth horn 32, and insert 38 may be removed.

The teachings of the present invention allow for simplified installation, removal, and/or replacement of adapter assemblies. These procedures may be performed by operators in the field, by an operator using simple hand tools. These techniques may be used to couple various different replaceable machine part components. For example, insert assembly 38 may be used to couple adapters, removable teeth for draglines and other earth moving equipment, shrouds, shanks and/or tooth horns, within the teachings of the present invention.

Although embodiments of the invention and their advantages are described in detail, a person skilled in the art could make various alterations, additions, and omissions without departing from the spirit and scope of the present invention as defined by the appended claims.

What is claimed is:

1. A removable adapter assembly, comprising:

a tapered body having a first end configured to receive a tooth horn, and a second end configured to receive a removable tooth;

the tapered body including first and second sides, which partially define a recess adjacent the first end; and first and second interior surfaces of the first and second sides, respectively, having first and second gripping surfaces, respectively, the first and second gripping surfaces configured to cooperate with a retractable insert that is coupled with the tooth horn such that the tapered body is coupled with the tooth horn when the retractable insert is in a first extended position, and the tapered body may be removed from the tooth horn when the insert is in a second, retracted position.

2. The removable adapter assembly of claim 1, wherein the first and second gripping surfaces comprise first and second pluralities of gripping teeth, respectively, the first and second pluralities of gripping teeth being configured to cooperate with third and fourth pluralities of gripping teeth which extend from opposing first and second ends of the insert, respectively, to secure the tapered body to the tooth horn, when the insert is in the first position.

3. The removable adapter assembly of claim 2, further comprising:

the retractable insert;

wherein the retractable insert is configured to be received at least partially within a slot through the tooth horn, the insert including an elongate body including the opposing first and second ends of the insert;

wherein the third and fourth pluralities of gripping teeth extend outwardly and engage the first and second gripping teeth when the retractable insert is in the first position; and wherein the third and fourth plurality of gripping teeth are retracted inward and disengage the first and second plurality of gripping teeth, respectively, when the insert is in the second position.

4. The removable adapter assembly of claim 3, wherein the insert further comprises:

a biasing element disposed between first and second portions of the elongate body, the first and second portions of the insert including the third and fourth pluralities of gripping teeth, respectively; and the biasing element being operable to maintain the first and second portions in respective outwardly extended positions when the insert is in the first position.

5. The removable adapter assembly of claim 4, wherein the insert further comprises:

a threaded fastener coupling the first and second portions; and wherein rotation of the fastener in a first direction causes movement of the second portion, relative to the first portion, such that the insert is retracted from the first position to the second position.

6. The removable adapter assembly of claim 2, further comprising:

the first and second sides including first and second removable racks, respectively;

the first and second racks each being at least partially recessed relative to the first and second interior surfaces, respectively; and wherein the first and second racks include the first and second gripping teeth, respectively.

7. The removable adapter assembly of claim 1, further comprising the retractable insert.

8. The removable adapter assembly of claim 3, wherein the first and second gripping surfaces are tapered from the second end to the first end, and the third and fourth gripping surface's are correspondingly tapered, such that movement of the tapered body toward the tooth horn tightens the coupling between the tapered body portion and the insert.

9. The removable adapter assembly of claim 4, wherein the first portion of the insert comprises:

a first shaped body configured to be received within a slot through the tooth horn, the first shaped body portion being moveable along the slot, with respect to the tooth assembly;

a first end of the first shaped body portion including a first recessed portion configured to receive a first end of the biasing element;

a first interior wall adjacent the first recessed portion being operable to engage the biasing element; and a second end of the first shaped body defining a threaded fastener opening configured to receive a threaded fastener.

10. The removable adapter assembly of claim 9, wherein the second portion of the insert comprises:

a second shaped body configured to be received within a slot through the tooth horn, the second shaped body portion being moveable along the slot, with respect to the tooth assembly and the first shaped body;

a first end of the second shaped body portion including a second recessed portion configured to receive a second end of the biasing element;

a second interior wall adjacent the second recessed portion being operable to engage the biasing element; and a second end of the second shaped body defining a shoulder configured to engage a fastener head.

11. The removable adapter assembly of claim 10, wherein the insert further comprises a threaded fastener including:

an elongate shaft having a threaded region and a fastener head opposite the threaded region;

the threaded region being operable to engage the first shaped body; and the fastener head being operable to engage the shoulder, wherein rotation of the fastener in a first direction extends the insert to the first position and rotation of the fastener in a second direction retracts the insert from the first position to the second position.

12. The removable adapter assembly of claim 4, wherein the biasing element comprises a spring.

13. The removable adapter assembly of claim 4, wherein the biasing element comprises an elastomer.

14. An adapter assembly, comprising:

a first end, a second end, and first and second sides;

a recessed portion adjacent the first end, the recessed portion defining a cavity configured to receive a tooth horn;

the first and second sides generally converging adjacent the second end;

a first rack coupled with the first side adjacent the recessed portion, the first rack including a first plurality of gripping teeth extending toward the recessed portion;

a second rack coupled with the second side adjacent the recessed portion, the second rack including a second plurality of gripping teeth extending toward the recessed portion;

an insert configured to be received at least partially within a slot formed through a tooth horn of an excavation equipment component, the insert including first and second structures, a biasing element, and a fastener; and the insert including a first position in which the first and second structures extend outwardly relative to each other, and a second position in which the first and second structures are retracted inwardly relative to one another.

15. A method for coupling an adapter assembly and a tooth horn, comprising:

inserting an insert at least partially through a slot through a tooth horn, the insert comprising first and second shaped body portions, the first and second shaped body portions having respective gripping surfaces adjacent opposite sides of the tooth horn;

the insert including a fastener extending at least partially through first and second fastener openings disposed at least partially through the first and second shaped body portions, respectively;

the first shaped body portion including a first threaded region operable to engage a corresponding second threaded region of the fastener, the second shaped body portion including a shoulder operable to engage a fastener head at an end of the fastener opposite the threaded region;

the insert including a biasing member disposed between the first and second shaped body portions, the biasing member being operable to engage first and second surfaces of the first and second shaped body portions, respectively, forcing the first and second shaped body portions generally away from one another;

installing an adapter at least partially over the tooth horn until third and fourth gripping surfaces associated with first and second sides of the adapter are generally adjacent the first and second gripping surfaces, respectively; and rotating the fastener in a first direction such that the first and second shaped body portions extend outwardly, until the first and second gripping surfaces engage the third and fourth gripping surfaces, and the adapter is secured in an installed position upon the tooth horn.

16. The method of claim 15, further comprising rotating the fastener in a second direction until the first and second shaped body portions retract and the first and second gripping surfaces are generally flush with the first and second sides of the tooth horn.

* * * * *